US005562257A

United States Patent [19]

Graveman et al.

[11] Patent Number: 5,562,257

[45] Date of Patent: Oct. 8, 1996

[54] DOUBLE ROTOR HAMMERMILL

[75] Inventors: Donald F. Graveman, St. Charles, Mo.; William F. Graveman, Tonganoxie, Kans.

[73] Assignee: Magnatech Engineering Incorporated, Tonganoxie, Kans.

[21] Appl. No.: 592,813

[22] Filed: Jan. 26, 1996

[51] Int. Cl.[6] ..... B02C 13/04; B02C 13/28

[52] U.S. Cl. ..... 241/190; 241/194; 241/236; 241/243; 241/285.3

[58] Field of Search ..... 241/86, 86.2, 87.1, 241/88, 88.3, 88.4, 194, 236, 243, 285.3, 190

[56] References Cited

U.S. PATENT DOCUMENTS

| | | | |
|---|---|---|---|
| 2,644,644 | 7/1953 | West . | |
| 2,756,002 | 7/1956 | Brake . | |
| 3,224,688 | 12/1965 | Beiter . | |
| 3,396,914 | 8/1968 | Liebman | 241/63 |
| 3,610,544 | 10/1971 | O'Connor . | |
| 3,637,144 | 1/1972 | Smith | 241/100 |
| 3,685,437 | 8/1972 | Panning | 100/45 |
| 3,815,521 | 6/1974 | Panning . | |
| 4,049,206 | 9/1977 | Konig et al. | 241/73 |
| 4,146,184 | 3/1979 | Whitney | 241/73 |
| 4,166,583 | 9/1979 | Ruckstuhl | 241/73 |
| 4,203,755 | 5/1980 | Ruckstuhl | 71/9 |
| 4,212,432 | 7/1980 | Bohne et al. | 241/285.3 |
| 4,560,110 | 12/1985 | Burda | 241/36 |
| 4,603,816 | 8/1986 | Panning | 241/266 |
| 4,718,614 | 1/1988 | Hausler et al. | 241/285.3 X |
| 4,739,939 | 4/1988 | Panning | 241/294 |
| 4,778,114 | 10/1988 | Panning | 241/37 |
| 4,793,561 | 12/1988 | Burda | 241/36 |
| 5,048,764 | 9/1991 | Flament | 241/36 |
| 5,201,475 | 4/1993 | Nakagomi | 241/236 |
| 5,248,100 | 9/1993 | Arakawa | 241/34 |

*Primary Examiner*—John M. Husar
*Attorney, Agent, or Firm*—Litman, McMahon and Brown, L.L.C.

[57] ABSTRACT

A hammermill includes a pair of rotors to each of which are attached a plurality of relatively long and relatively short hammers. In one embodiment each long hammer on one rotor is arrayed opposite a short hammer on the other rotor such that, as the rotors rotate, a circular path described by an end of each long hammer is in close proximity to a circular path described by an end of a corresponding short hammer on the other rotor. The long hammers are interleaved and a plurality of impact plates are shaped and positioned in close proximity to the hammer circular tip paths so that materials being reduced by the hammermill impact the impact plates until the materials are reduced to a desired size. The inventive hammermill is particularly effective in reducing tough and pliable materials such as automobile tires as well as light materials such as paper and aluminum cans.

11 Claims, 3 Drawing Sheets

DOUBLE ROTOR HAMMERMILL

BACKGROUND OF THE INVENTION

The present application is directed to improvements in hammermills and, in particular, to improvements directed to enhancing the ability of hammermills to tear and commutate materials that are especially resistant to tearing such as tires and certain plastics, as well as other materials conventionally reduced by hammermills.

Hammermills have historically been utilized to reduce the size of or commutate a large number of materials. Conventional hammermills have been especially useful in reduction of highly frangible materials or materials that tear easily. For example, although cast iron, such as is used in engine blocks, would appear to be very strong and durable, this material is actually fairly frangible and relatively easy to break in a hammermill. Consequently, hammermills have frequently been used to shred automobiles or at least parts of automobiles.

However, conventional hammermills have been less effective in reducing materials that are not frangible and/or resistant to tearing. Examples of materials of this type are tires and certain plastics that are pliable and very tough, such that conventional beating by a hammermill merely bends or works the materials but does not break them. Other examples of problem materials include flexible sheet materials that tend to simply wrap about hammers and other hammermill components rather than being torn by the hammers. Materials of the latter type can include sheet aluminum and paper, for example.

Because of environmental and other changes, it is becoming increasingly important and economically viable to shred or commutate materials that have been historically difficult to reduce in a hammermill. For example, because worn tires have substantial disposal problems due to an ever decreasing amount of suitable landfill space and environmental restrictions on burning, alternative uses of such tires have been developed. These alternative uses included shredding tires to a fairly small particle size and then using the shredded particles in some type of construction. A typical use of shredded tires is as a component in the production of road construction materials, such as asphalt.

Disposal of medical wastes is another area in which environmental concerns have dictated major changes that limit simple dumping of the wastes. Often it is desirable to reduce the volume of medical waste for storage or transport to an area where destruction can occur. Such reduction would normally be a suitable task for a hammermill, but many components of medical waste are constructed of tough pliable plastics or rubbers that are not easily reduced in a conventional hammermill.

Consequently, it is desirable to have a hammermill construction that has improved ability to tear, cut and/or chew apart tough and pliable materials.

Certain other problems also arise out of trying to shred certain flexible materials in hammermills. One of these problems is that hammermills rotate at a relatively high rate of speed, thus producing a substantial air flow. Light materials may be carried or blown about the hammermill by the air flow so that the blown materials are never struck by the hammers and may block feed of new materials into the hammermill. Consequently, it is also desirable that construction of the hammermill restrict the flow of materials therein due to air currents.

SUMMARY OF THE INVENTION

An improved hammermill is provided that allows the shredding of tough pliable materials while restricting materials being blown by air.

The hammermill of the present application includes dual, preferably horizontally spaced rotors with multiple hammers attached to each rotor. Preferably, the hammers are swingable, but may be non-swingable or rigid hammers in certain embodiments. The hammers on each rotor are axially arranged along the rotor and are preferably alternated between relatively long and short lengths. Preferably, the long and short hammers on the two rotors are staggered or aligned such that the long hammers on one rotor are aligned to be across from or opposite short hammers of the opposed rotor and at least some of the hammers on one rotor interleaf with hammers on an opposite rotor. Furthermore, the arcs described by the tips of the opposed long and short hammers are closely spaced and, therefore, each of the long hammers interleaves with the adjacent, staggered long hammers on the other rotor. In an alternative embodiment the long hammers are aligned opposite long hammers and short hammers are aligned to be opposite short hammers with a plate located between the short hammer.

The hammermill includes at least one comb shaped structure or sizing impact plate. The impact plate extends between a housing of the hammermill and the arcs of the hammers. Preferably the impact plate includes a series of fingers and slots that substantially align with and are located in close proximity to the arcs of the short and long hammers, respectively, that is the arcs of long hammers are aligned with the slots and the arcs of the short hammers are aligned with the fingers.

With many materials the specific eventual size of reduced particles of material can be substantially determined by the spacing between the arcs of the tips of the hammers and the fingers and slots of the sizing impact plates.

OBJECTS AND ADVANTAGES OF THE INVENTION

Therefore, the objects of the present invention include: to provide a hammermill that is especially suited for cutting, tearing or otherwise shredding materials that are both tough and pliable; to provide such a hammermill that further functions to shred sheet type materials and materials that would otherwise be subject to being blown by air currents within the hammermill; to provide such a hammermill having a pair of horizontally spaced rotors with hammers secured to each rotor wherein the hammers are arranged axially along the exterior of each rotor and alternate between relatively long and short hammers; to provide such a hammermill wherein long hammers of each rotor are positioned opposite short hammers on the opposite rotor and circular tip paths described by the swinging tips of each long hammer pass within close proximity to the circular tip paths of the tips of opposed short hammers; to provide such a hammermill wherein each of the long hammers interleaves with long hammers adjacent an opposed short hammer; to provide such a hammermill wherein long hammers of one rotor are positioned opposite long hammers of the other rotor while short hammers are located opposite short hammers with a striking plate therebetween; to provide such a hammermill having at least one sizing impact plate that extends from a housing of the hammermill to within close proximity of the circular paths of the tips of the hammers and includes alternating fingers and slots aligned with the paths of short and long hammers respectively; to provide such a hammermill wherein at least one cutter bar is utilized to provide a surface for materials to impinge upon under force exerted thereon by the hammers so as to increase likelihood of tearing of the materials; to provide such a hammermill adapted to receive incoming materials from various different input means including conveyors and hoppers; and to provide such a hammermill that is easy to use and is especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
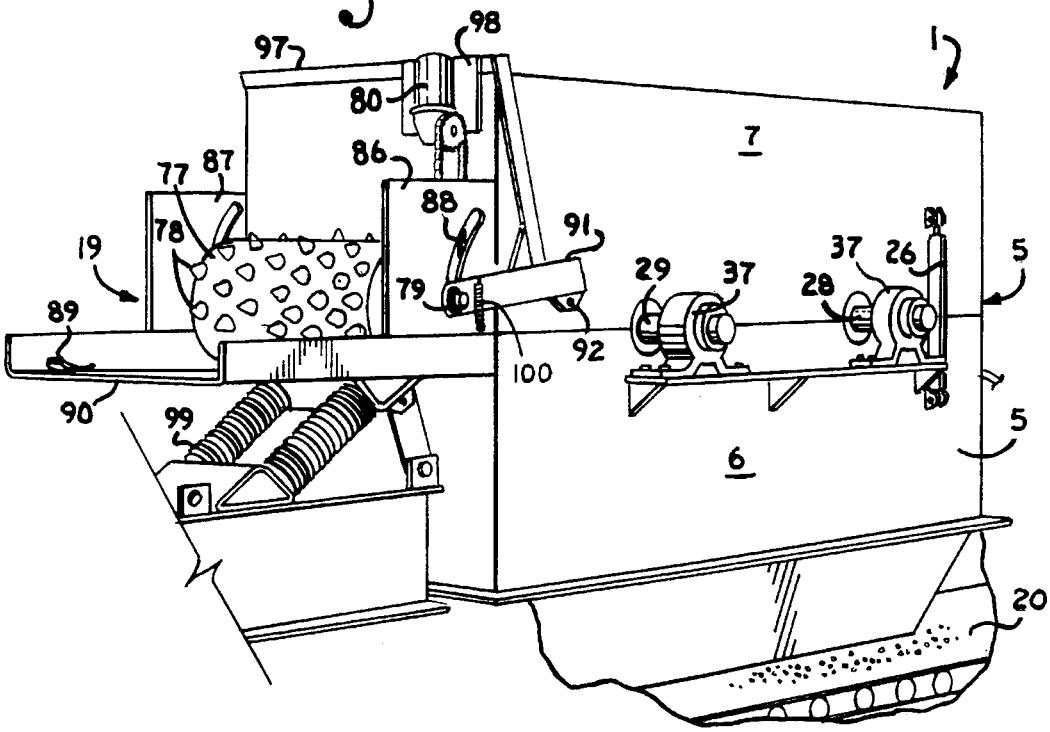
FIG. 1 is a perspective view of a hammermill in accordance with the present invention, including a feed mechanism and a lower transfer conveyor for removing reduced materials.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in detail, the reference numeral 1 generally represents a hammermill in accordance with the present invention which is shown in FIGS. 1 through 5. The hammermill 1 includes a structural housing 5 with a fixed bottom portion 6 and a top portion 7 connected thereto by hinges 8. Within the housing 5 are positioned a horizontally spaced pair of hammer carrying cylindrical rotors 9 and 10, and rotating means for rotating the rotors 9 and 10, such as the illustrated electric motors 11 and 12, respectively. A sizing impact plate system 16, a grate system 17, a cutter bar 18, input means such as conveyor and feed roller system 19 and discharge means such as discharge conveyor 20 are also illustrated, and will be further described below.

Figure 2:
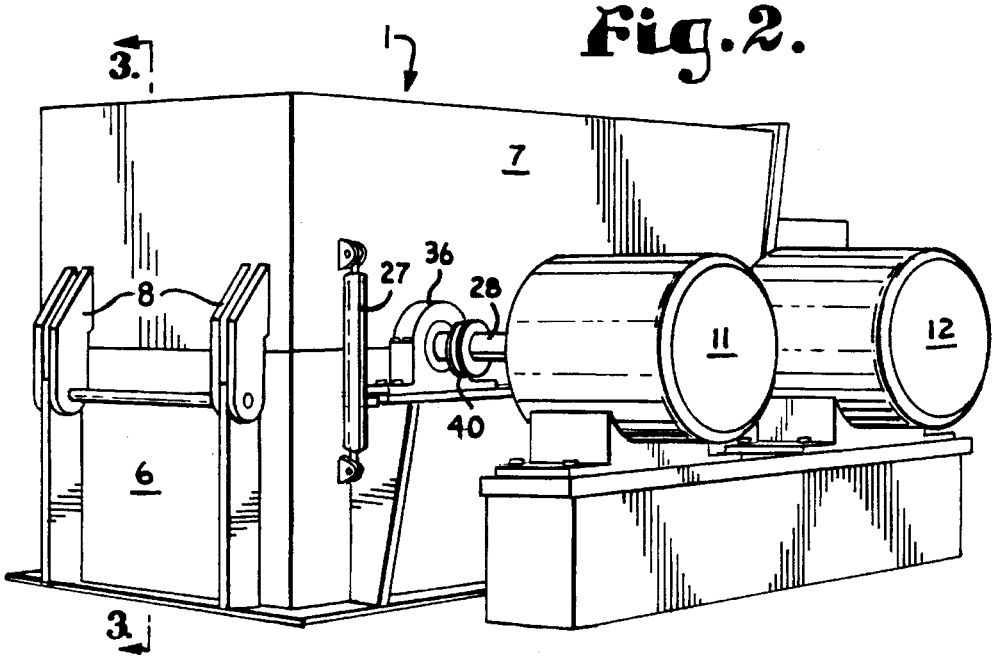
FIG. 2 is perspective view of the hammermill shown in FIG. 1 from the opposite direction.

Referring to FIGS. 1 and 2, a pair of hydraulic cylinders 26 and 27 are provided on respective opposite sides of the housing 5, with the cylinders 26 and 27 and associated telescoping pistons extending between the housing top portion 7 and the bottom portion 6 to selectively allow opening of the top portion 7 to provide access to the interior of the hammermill 1.

A pair of drive shafts 28 and 29 extend through the housing 5 from side to side, are positioned at the junction between the bottom and top portions 6 and 7 and are supported by the bottom housing 6. With this arrangement, the top housing portion 7 is unencumbered by any equipment which would need to be removed prior to raising the top portion 7 to gain access to the interior of the hammermill 1, thus making interior access very convenient. Each drive shaft 28 and 29 is rotatably driven by a respective one of the motors 11 and 12. Also each drive shaft 28 and 29 is supported by bearings 36 and 37 positioned outside the housing 5. The rotors 9 and 10 are attached to the shafts 28 and 29, respectively via keyways and keys 38. The motors 11 and 12 are joined to respective shafts 28 and 29 by flexible joints 40.

Each of the cylindrical rotors 9 and 10 have attached thereto a plurality of hammers which include relatively short hammers 46 and relatively long hammers 47. The short and long hammers 46 and 47 are alternately arrayed longitudinally along the length of each rotor with four identical and equally spaced hammers 46 or 47 radially arrayed about each axially spaced hammer position on each rotor 9 and 10. The respective hammers 46 and 47 on the rotor 9 are staggered with respect to the hammers 46 and 47 on the rotor 10. In other words, the hammers 46 and 47 are arranged such that each short hammer 46 the rotor 9 is positioned directly opposite a long hammer 47 on the rotor 10 and vice versa. It is foreseen that other arrangements of long and short hammers are usable under the present invention, including the pairing of two or more short or long hammers side by side and interleafing with like opposite groupings. The lengths of each short and long hammer 46 and 47 are such that the circular path described by each short hammer tip 48 as it is rotated with its respective rotor reaches just short of and in relatively close proximity to the circular path described by an opposite long hammer tip 49.

Figure 5:
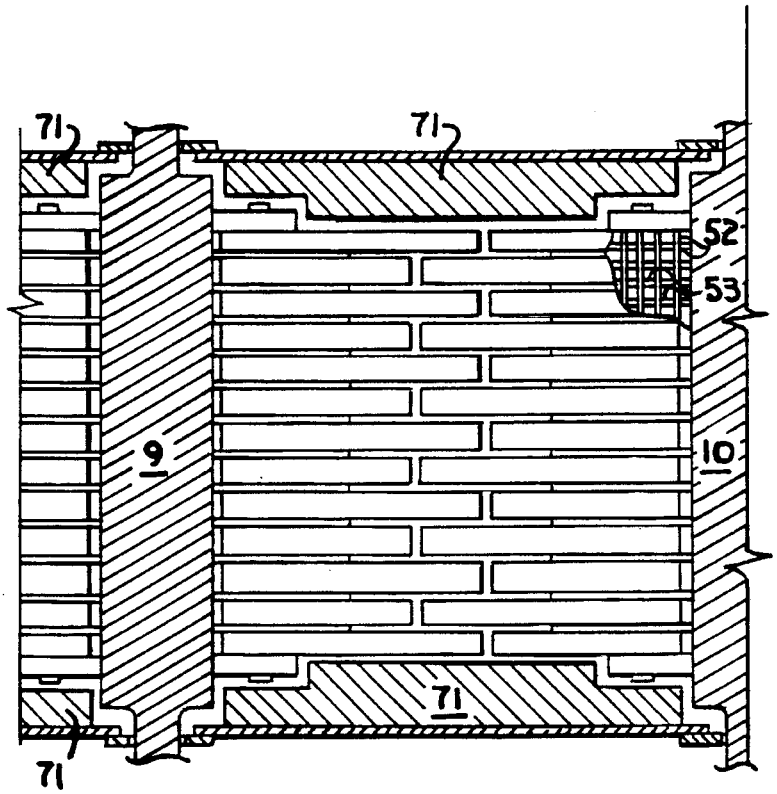
FIG. 5 is a fragmentary and cross sectional view on an enlarged scale of the hammermill, taken along line 5—5 of FIG. 3, and with portions broken away to illustrate a grate system.

The grate system 17 includes a pair of semi-circular grates 50 and 51 which are shaped to approximate the circular path of the hammers 47. The grates 50 and 51, for example, may be made of orthogonally arranged and welded lengths of rectangular bar 52, as shown in FIG. 5. It is foreseen that the grates may be formed by drilling circular apertures in plates and in other ways to provide a strong structure with suitably sized openings therein. The crossed bars 52 are spaced to leave rectangular openings 53 of a preselected size through which reduced material is allowed to exit the hammermill 1. The openings 53 thus also act as a gauge to determine the final size of reduced material which exits the hammermill 1. The gratings 50 and 51 meet in the middle of the housing 5 to form a peak 54.

Figure 3:
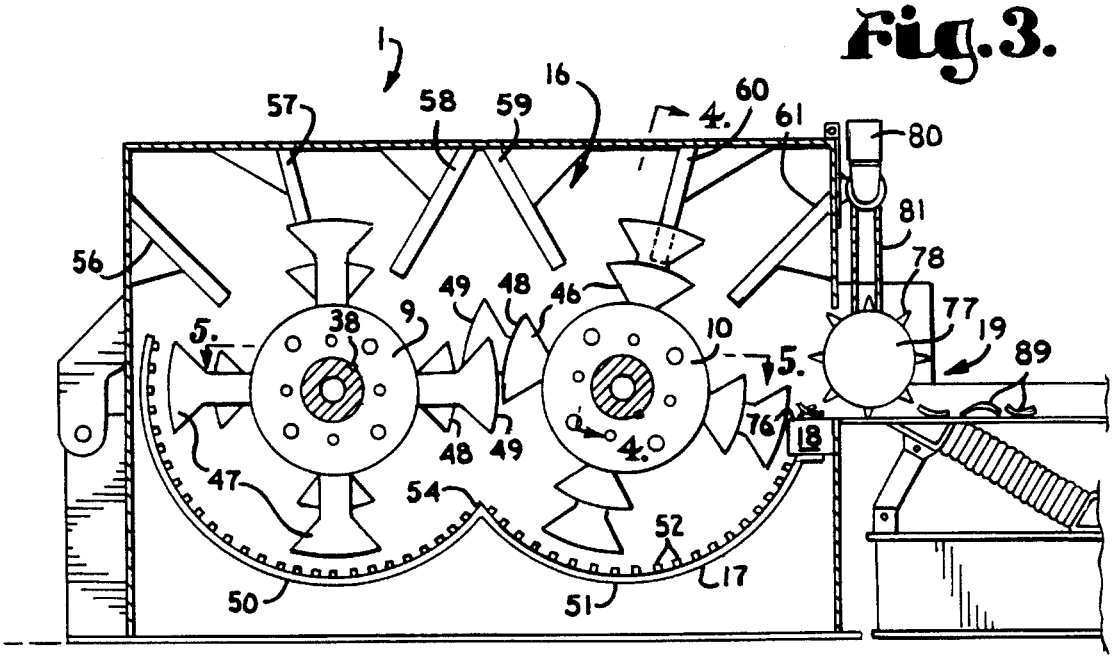
FIG. 3 is a cross-sectional view of the hammermill taken along line 3—3 of FIG. 1.
Figure 4:
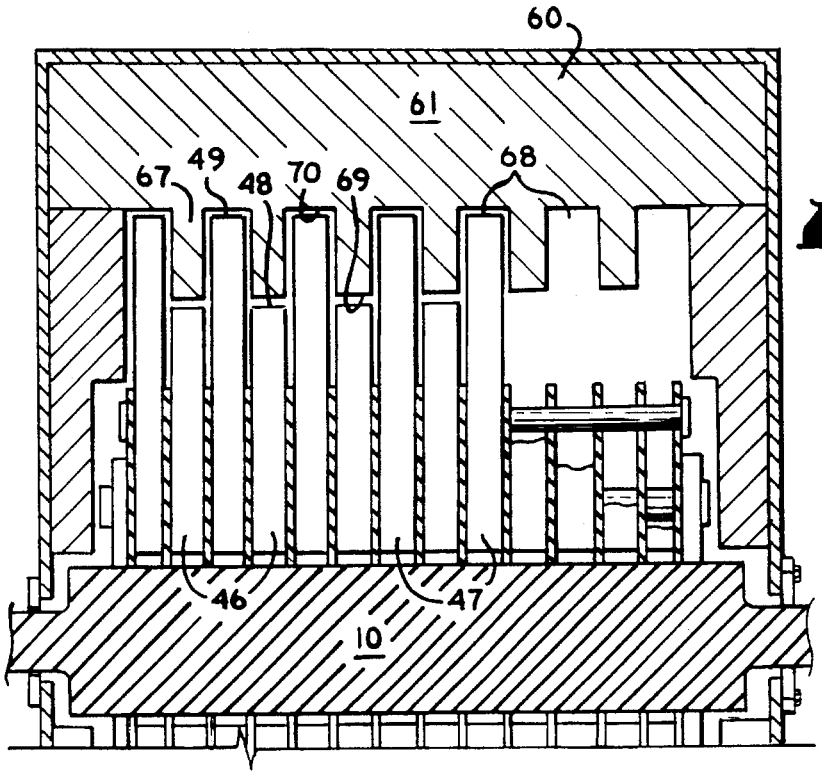
FIG. 4 is a fragmentary and cross-sectional view on an enlarged scale of the hammermill, taken along line 4—4 of FIG. 3, and illustrating a sizing impact plate in close proximity to the swinging hammers.

The sizing impact plate system 16 includes a plurality of comb shaped structures or sizing impact plates 56–61, as is best illustrated in FIGS. 3 and 4. The plates 56 and 61 extend inward and downward from opposite ends of the top housing portion 7, while the plates 57–60 are attached to and extend downward at an angle from the top of the top housing portion 7. Each of the plates 56–61 has the same general shape, although length may vary as needed to fit the housing 5, and thus only the plate 60 is illustrated in detail in FIG. 4.

The plate 60 includes a base portion 66 and a plurality of finger-like extensions or fingers 67. The base position 66 is generally sealed to or abutted against the interior wall of the housing 5 on the three sides thereof except for the side having the fingers 67 so as to prevent flow therebetween. The fingers 67 are of a length which is approximately equal to the difference in length between the short hammers 46 and the long hammers 47. Between each adjacent pair of the fingers 67, a slot 68 is positioned. The tips 48 of each of the short hammers 46 reaches within close proximity of the end of a respective one of the fingers 67, as the hammers 46 describe their rotary arc, leaving a gap 69, while the tips 49 of each of the long hammers 47 reaches within close proximity of the end of a respective one of the slots 68 as the hammer 47 describe their rotary arc, leaving a gap 70. The gaps 69 and 70, which are preferably similar in size, act to cause any piece of material which is larger than the gaps 69 and 70 to be impinged on the plate 60 and immediately or eventually struck by one of the hammers 46 or 47 such that the hammers 46 and 47 chew away at the pieces and make them smaller, especially not larger than the size of the gaps 69 and 70. Thus, the gaps 69 and 70 act to determine the diameter size of final material fragments as the hammermill 1 fractures and/or tears the material.

In addition, the sizing impact plates 56–61 act as a barrier to circular air flow within the hammermill 1 generated by the high rate of rotation of the hammers 46 and 47. Thus, relatively light materials, which would otherwise be blown about the interior of the hammermill 1, and would thereby avoid the hammers 46 and 47 and which would also tend to clog the grating 17 and cutter bar 18, etc., instead impact the plates 56–61 and are subsequently impacted and effectively further shredded by the hammers 46 and 47. This greatly increases the efficiency and throughput capabilities of the hammermill 1 while limiting the need for frequent opening of the housing 5 to clear away light material from the hammers 46 and 47, the grating system 17 and the cutter bar 18. In order to further reduce air flow within the hammermill 1, a plurality of side plates 71 are positioned between end walls of the housing 5 and the swinging hammers 46 and 47 (FIG. 5).

Referring again to FIGS. 1 and 3, the cutter bar 18 is preferably a steel bar with an upper and rotor facing edge 76. The bar 18 extends across the entire width of the hammermill 1 from side to side.

The conveyor and feed roller system 19 includes a conveying feed roller 77 which is equipped with a number of gripping teeth 78. The roller 77 is rotatably driven about a shaft 79 by a drive means, such as a motor 80 and a belt or chain 81. The shaft 79 extends between a pair of plates 86 and 87, each of which has a slot 88 extending therethrough. The shaft 79 is thus movable up and down within the slots 88 to raise and lower the roller 77 to accommodate varying sizes of material, such as the illustrated material chunks 89, to be reduced as well as to vibrate with a vibrator feed table 90. The shaft 79 also extends between a pair of generally horizontal support arms 91 which are pivotably attached to the upper housing 7 at pivot points 92. The arms 91 are also attached to a pair of generally vertical support arms 96, which are, in turn, connected to a cross member 97 which supports a plate 98 to which the motor 80 is attached. With this arrangement, when the roller 77 is moved up or down in the slots 88, the motor 80 and belt 81 are moved as well to keep tension on the belt 81 so that drive for the roller 77 is uninterrupted.

Vibrator tables are well known in the art. The table 90 is positioned beneath the roller 77 and is connected to a pair of large springs 99 and smaller springs 100 and to a vibrating means (not shown) which vibrates the table 90 in conventional fashion to load material, such as the fragments 89, to be reduced into the hammermill 1.

Once the fragments 89 are conveyed into the hammermill 1 via the vibrator table 90 and the roller 77, they reach the cutter bar 18 and are sheared between the cutter bar edge 76 and the swinging tips 49 of the long hammers 47, thus immediately reducing the size of input material to make the hammermill 1 more effective. In addition, with each rotation of the hammers 47 attached to the rotor 10, material within the hammermill 1 is also sheared between the hammer tips 49 and the cutter bar edge 76.

With its axially alternating short and long hammers 46 and 47, respectively, the hammermill 1 can be asynchronously driven, i.e., the rotors 9 and 10 can be driven at different speeds, thus varying the impact of the hammers 46 and 47 on material within the hammermill 1.

Figure 7:
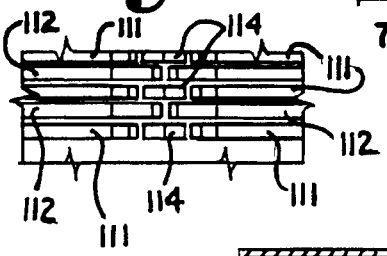
FIG. 7 is fragmentary cross-sectional view of the modified hammermill, taken along line 7—7 of FIG. 6.
Figure 6:
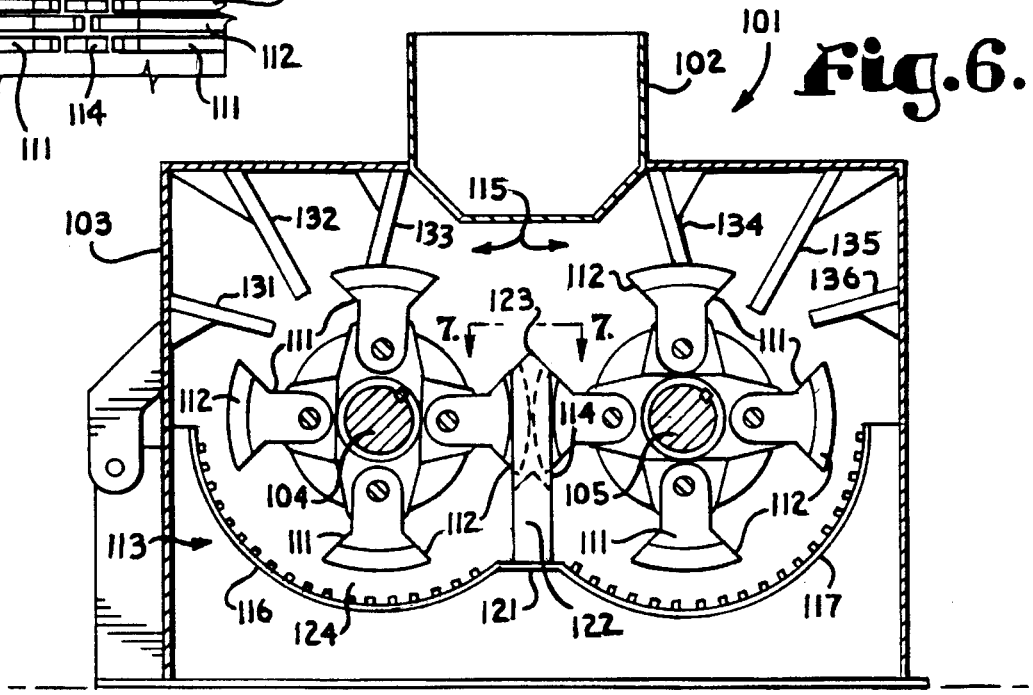
FIG. 6 is a cross-sectional view of a modified hammermill in accordance with the present invention.

Referring to FIGS. 6 and 7, an alternate embodiment of a hammermill in accordance with the present invention is illustrated and referred to generally by the reference numeral 101. In the hammermill 101, which is designed for top loading of material to be reduced, a centrally located input chute 102 is provided in the top of a cabinet 103. A pair of opposed rotors 104 and 105 are driven and have attached thereto a plurality of short hammers 111 and long hammers 112, but, unlike the hammermill 1 in FIGS. 1–5, these hammers 111 and 112 are aligned such that the long hammers 112 of one rotor 104 are aligned to be opposite long hammers 112 of the other rotor 105 and the short hammer 111 on rotor 104 are aligned opposite short hammer 111 of the opposite rotor 104 and have a striker plate 114 located between opposite short hammers 111. It should be noted that the various long hammers 112 and short hammers 111 will not always be in axial alignment when passing the striking plate 114 as is shown in FIG. 6. This is because the rotors 104 and 105 are normally driven at synchronous speeds, although it would be possible to have them rotate synchronously. It has been found that for many materials, especially materials that are sheetlike or tough, that differential rotational speeds from 1 to the range from about 2 to 5 are effective for the rotors 104 and 105 where possible the slower rotor first receives materials and the faster rotating rotor cleans the slower. Impact plates 115 such as described for the earlier embodiment are also used here to help reduce the size of materials and to clear or remove sheet like material and the like from the rotor hammers 111 and 112.

A grating system 113 is positioned in the bottom of the hammermill 101, with two semi-circular grates 116 and 117 which come together to form a ledge 121. Attached to the ledge 121 is a support 122 which extends across the width of the hammermill 101. The support 122 supports the striker plates 114 which each terminates in a sharpened edge 123. The sharpened edge 123 acts as a cutter in a fashion similar to the edge of the cutter bar 18 in FIG. 3.

Material introduced via the chute 102 is carried straight down by the hammers 111 and 112 and is sheared between the edge 123 and rotating tips 124 of the longer hammers 112. Material already in the hammermill 101 is also repeatedly sheared between the edge 123 and the hammer tips 124 and through impact and tearing on the impact plates 115 with each revolution until the reduced material is small enough to drop through openings in the grates 116 and 117. The hammermill 101 also includes the impact sizing plate system, indicated generally as 115 includes individual plates 131–136. Each of the plates 115 includes slots (not shown)

equal to the number of radial hammer sets to accommodate the long hammers 112 of each such set.

The inventive hammermills 1 and 101 thus represent a significant advance in the art, enabling extremely tough and durable materials such as automobile tires to be effectively sheared and shredded. In addition, lighter materials such as paper and aluminum, due to the reduced circular air flow, are also effectively shredded while greatly reducing down time and maintenance expenses of the hammermills 1 and 101.

It is foreseen that the distal ends or tips of the various hammers described herein can have different geometrics depending on the material to be worked by the hammermill. In some instances the ends may be at least as wide as the base. At other times, especially when working with sheet material or rubbery material where tearing is necessary, the ends may be pointed, as in the top of a pyramid.

It is to be understood that while certain forms of the present invention have been illustrated and described herein, it is not to be limited to the specific forms or arrangement of parts described and shown.

What is claimed and desired to be secured by Letters Patent is as follows:

1. A hammermill apparatus for reducing materials comprising:

a) structural housing and frame means for forming an enclosure;

b) a pair of hammermill rotors rotatably mounted within said enclosure;

c) motor means for operably rotating said rotors;

d) materials feed means for feeding materials to be reduced into said enclosure;

e) material discharge means for removing reduced materials from said frame means;

f) each of said rotors having mounted thereon a set of rotatable hammers; each of said hammers being swingably mounted relative to a respective rotor to which a hammer is mounted; each of said hammers extending radially outward from a respective rotor when fully extended and having an end that describes a circular path when a respective rotor is rotating; each of said hammer sets including at least one relatively short first hammer and at least one relatively long second hammer; each of said sets of hammers being positioned such that during rotation of the rotors, each long hammer of each set is opposite a respective short hammer of the other set and so that a circular path associated with rotation of each long hammer end of one set passes in close proximity to a circular path associated with rotation of an end of a respective short hammer of the other set;

g) the long and short hammer elements on each rotor being alternated in an axial direction along a respective rotor such that the hammer elements on opposite rotors are staggered, so that the circular paths described by ends of the long hammer elements of both rotors overlap and so that when the rotors are axially aligned, portions of said long hammer elements on each rotor are interleaved with similar portions of long hammer elements on the opposite rotor;

h) a sizing impact plate for sizing reduced materials; said plate being fixedly mounted on said frame means spaced from said materials feed means and extending into said enclosure; said impact plate being spaced from and extending longitudinally along a first of said rotors; said impact plate having an impact surface for collecting materials to be reduced; said surface having an edge facing said first rotor that includes fingers extending outward therefrom toward said first rotor; said fingers being spaced to provide slots therebetween, said impact plate being aligned such that the end circular path of each said long hammed on said first rotor pass in close proximity to a rearward side of a respective one of said slots and the end circular tip paths of each said short hammer on said first rotor pass in close proximity to an outer edge of a respective one of said fingers; and i) a cutting bar; said cutting bar being positioned to be spaced from said impact plate and near said materials feed means so as to receive materials thereon and have the materials cut by said rotor hammers; said cutting bar also positioned to extend axially along and parallel to at least a first rotor and being located in close proximity to the end circular paths of the long hammers of said first rotor, such that materials entering said apparatus are struck against said cutting bar to cut and reduce the materials.

2. The apparatus according to claim 1 wherein:

a) said motor means includes asynchronous means for rotating said rotors at different speeds.

3. The apparatus according to claim 1 wherein:

a) the distance between the impact plate and the hammers as the ends thereof describe said circular paths is relatively small compared to the size of the materials to be reduced such that said hammers tear and reduce the materials at said impact plate to a selected size.

4. The apparatus according to claim 3 including:

a) a screen grate located between said hammers and said discharge means; said grate having apertures therein sized to allow passage of materials reduced to the selected size as determined by spacing of the impact plate from said hammers.

5. The apparatus according to claim 1 wherein:

a) a said cutting bar is located at an intersection between the two sets of hammers and is aligned to extend axially with and parallel to the rotors.

6. The apparatus according to claim 1 wherein:

a) said feed apparatus includes conveying means for transferring materials to be reduced to said apparatus; and b) a feed roll located at a discharge of said conveying means into said apparatus; said feed roll including motor means for rotating said roll, biasing means for urging said feed roll against the materials and grasping means mounted on said roll for engaging and urging the materials into said apparatus upon rotation of said feed roll.

7. The apparatus according to claim 1 wherein a) said support and frame means includes a bifurcated housing having a bottom section supporting said rotors and a top section;

b) said top section being hinged to said bottom section such that said top section is selectively openable to allow access to an interior of said enclosure.

8. The apparatus according to claim 7 and further comprising:

a) hydraulic means for selectively opening said top section and wherein the top section is free from equipment that would require disassembly prior to opening.

9. A hammermill apparatus for reducing materials comprising:

a) structural housing and frame means for forming an enclosure;

b) said support and frame means including a housing having a bottom section supporting said rotors and a top section;

c) said top section being hinged to said bottom section such that said top section is selectively openable to allow access to an interior of said enclosure;

d) a pair of hammermill rotors rotatably mounted within said enclosure;

e) each of said rotors having mounted thereon a set of swingable hammers; each of said hammers extending radially outward from a respective rotor and having a tip that describes a circular path as the associated rotor is rotated; each of said hammer sets including a relatively short first hammer and a relatively long second hammer; each of said sets of hammers being positioned such that during rotation of the rotors, each long hammer of each set is rotated so as to pass opposite a respective short hammer of the other set and so that the end circular path associated with each long hammer of one set passes in close proximity to the end circular path associated with a respective short hammer of the opposite set;

f) an outer portion of each long hammer of one set interleaves with outer portions of long hammers of the opposite set when said hammers are fully extended and radially aligned toward each other;

g) motor means for operably rotating said rotors;

h) materials feed means for feeding materials to be reduced into said frame means;

i) said feed means including conveying means for transferring materials to be reduced to said apparatus;

j) a feed roll located at a discharge of said conveying means into said apparatus; said feed roll including motor means for rotating said roll, biasing means for urging said feed roll against the materials and grasping means mounted on said roll for engaging and urging the materials into said apparatus upon rotation of said feed roll;

k) a sizing impact plate; said plate being fixedly mounted on said frame means and extending into said enclosure; said impact plate being spaced from and extending longitudinally along a first of said rotors; said impact plate having an impact surface for collecting materials to be reduced; said surface having an edge facing said first rotor that includes fingers extending outward therefrom toward said first rotor; said fingers being spaced to provide slots therebetween, said impact plate being aligned such that the end circular paths of each said long hammer on said first rotor passes in close proximity to a rearward side of a respective one of said slots and the end circular paths of each said short hammer on said first rotor passes in close proximity to a tip of a respective one of said fingers;

l) the distance between the impact plate and the circular paths of the end of the hammers being relatively small compared to the size of the materials to be reduced such that said hammers tear and reduce the materials at said impact plate to a selected size;

n) material discharge means for removing reduced materials from said frame means; and o) a screen grate located between said hammers and said discharge means; said grate having apertures therein sized to allow passage of materials reduced to the selected size.

10. The aperture according to claim 9 including:

a) a cutting bar; said cutting bar being positioned to extend axially along at least a first rotor and being located in close proximity to the end circular paths of the long hammers of said first rotor, such that materials entering said apparatus are struck against said cutting bar in a manner to cut and reduce the materials.

11. In a hammermill apparatus having first and second rotatable rotors each with a set of hammer elements mounted on and extending radially outward from said rotors, the improvement comprising:

a) each said set of hammer elements contains at least one relatively long hammer element and at least one relatively short hammer element;

b) the long hammer elements of each rotor are aligned to rotate directly opposite the long hammer elements of the other rotor such that an end of each long hammer on the first rotor, when rotated by the rotation of said first rotor, describes a circular path which is located in close proximity to a circular path defined by the rotation of an end of a corresponding long hammer on the second rotor; each short hammer element on the first rotor having an opposite short hammer element in the second rotor that axially aligns therewith at intermittent times during rotation; and c) a striking plate positioned between and in close proximity to the distal ends of said short hammers when the short hammers are axially aligned.

* * * * *